US007676878B2

(12) United States Patent
Parker-Smith

(10) Patent No.: US 7,676,878 B2
(45) Date of Patent: Mar. 16, 2010

(54) BARREL CLEANING SYSTEM

(76) Inventor: Steven Charles Merrix Parker-Smith, 13523 Pegasus Rd., Houston, TX (US) 77429

( * ) Notice: Subject to any disclaimer, the term of this patent is extended or adjusted under 35 U.S.C. 154(b) by 1020 days.

(21) Appl. No.: 11/395,318

(22) Filed: Mar. 31, 2006

(65) Prior Publication Data

US 2006/0218735 A1 Oct. 5, 2006

Related U.S. Application Data

(60) Provisional application No. 60/667,602, filed on Apr. 1, 2005.

(51) Int. Cl.
*F41A 29/00* (2006.01)
*B08B 9/049* (2006.01)

(52) U.S. Cl. ..... 15/104.05; 15/104.2; 15/104.31; 42/95; 134/8

(58) Field of Classification Search ..... 15/104.05, 15/104.09, 104.095, 104.12, 104.16, 104.2, 15/104.31; 42/95; 134/8
See application file for complete search history.

(56) References Cited

U.S. PATENT DOCUMENTS

| | | | | | |
|---|---|---|---|---|---|
| 306,455 | A | * | 10/1884 | Abraham | 15/104.2 |
| 2,917,762 | A | * | 12/1959 | Xenis | 15/104.05 |
| 2,974,932 | A | * | 3/1961 | Xenis | 254/134.5 |
| 3,144,240 | A | * | 8/1964 | Connell | 254/134.5 |

FOREIGN PATENT DOCUMENTS

| | | |
|---|---|---|
| GB | 883648 | 12/1961 |

* cited by examiner

*Primary Examiner*—Mark Spisich
(74) *Attorney, Agent, or Firm*—John R Casperson

(57) ABSTRACT

Improvements are provided to an apparatus for cleaning a tubular. One set of improvements is provided by a nose shaft extending from the motor, a cone positioned on the shaft, and a brush positioned on the shaft between the nose cone and the vibratory motor. Another set of improvements is provided by a new passage and port arrangement on the piston and sleeve for the vibratory motor. Another improvement is provided by a set of passages and ports to provide oil flow to the area being cleaned. Another improvement is provided by capturing exhaust gas from the motor and exhaust of same at a location away from the operator of the unit.

6 Claims, 5 Drawing Sheets

BARREL CLEANING SYSTEM

CROSS REFERENCES TO RELATED APPLICATIONS

This application claims the benefit of U.S. Provisional Application No. 60/667,602 filed Apr. 1, 2005, the disclosure of which is herein incorporated by reference.

FIELD OF THE INVENTION

In one aspect, the invention relates to an air tool. In another aspect, the invention relates to a pipe cleaning apparatus. In another aspect, the invention relates to a method for cleaning tubulars.

BACKGROUND OF THE INVENTION

The insides of tubes used in certain applications must be periodically cleaned in order to preserve performance. For example, both boiler tubes and cannon bores accumulate performance-reducing deposits when used which must be periodically removed.

Pneumatic vibrators which carry brushes are known to be effective tools to remove or at least reduce the deposits. In the case of large artillery guns, this device is also very efficient, reducing the amount of maintenance required for each gun by nearly ½ man-year for each year the gun is in service, as compared to hand-cleaning with brushes.

However, improvements can still be made in providing more effective cleaning, the application of protective coatings, and the control of materials released into the environment during the cleaning process, and it is an object of this invention to provide such improvements.

OBJECTS OF THE INVENTION

It is an object of this invention to provide a barrel cleaning device that is short in length and easy to use.

It is another object of this invention to provide a barrel cleaning device that employs modular brushes which are easy to replace.

It is another object of this invention to provide a barrel cleaning device which employs a modular nose cone and tail piece that can be provided in a range of diameters to accommodate different bore diameters.

It is another object of this invention to provide a barrel cleaning device which provides a pressurized supply of oil to the inside of the bore to facilitate the cleaning process.

It is another object of this invention to provide a barrel cleaning device in which the air exhaust stream may be routed away from the operator of the system.

It is another object of this invention to provide a barrel cleaning system whereby the CLP does not have to come into contact with the operator to provide a safety factor.

It is another object of this invention to provide a barrel cleaning device which employs multiple heads to facilitate the various stages of barrel cleaning.

It is another object of this invention to provide a barrel cleaning device which employs a simple and rugged spindle and shuttle design which is more rugged than existing designs, as well as being simpler to fabricate.

SUMMARY OF THE INVENTION

One embodiment of the invention provides a pneumatic motor unit for driving a brush assembly through a bore. The motor unit comprises a vibratory motor, a generally cylindrical sleeve surrounding the motor, and centralizers mounted to the sleeve to accommodate different bore diameters. The vibratory motor is of the type having an internal reciprocating annular piston riding between an axially positioned spindle and an outer sleeve. A nose end cap and a tail end cap seal the outer sleeve, to form the cylinder heads. The generally cylindrical outer sidewall surrounds the outer sleeve and is fixedly attached to the nose end cap and the tail end cap. The outer sidewall has a nose end and a tail end and defines an outside diameter. A nose end centralizer body is mounted to the nose end of the generally cylindrical sidewall and forms a guide to facilitate said pneumatic motor unit being received in a bore to be cleaned. A tail end centralizer body is mounted to the tail end of the generally cylindrical sidewall and forms a guide to facilitate said pneumatic motor unit being received in a bore to be cleaned.

Another embodiment of the invention provides a brush assembly well suited for attachment to the pneumatic motor unit as just described. The brush assembly comprises a mandrel, a nose cone, and a collar shaped brush. The mandrel has an annular flange and a shaft extending axially from the annular flange. It has a nose end and a tail end. The nose cone is mounted on the nose end of the mandrel. The collar shaped brush fixedly mounted on the shaft between the nose cone and the annular flange.

Another embodiment of the invention provides a device for cleaning tubulars. It comprises a vibratory motor, a nose shaft, a nose cone, and a brushing means. The longitudinally elongated vibratory motor is contained in a motor housing. The rigid nose shaft extends axially from one end of the motor housing and has a nose end and a tail end. The nose cone is positioned on the nose end of the rigid nose shaft to facilitate starting the cleaning apparatus into a tubular. The brushing means comprises at least one collar shaped brush longitudinally fixedly positioned around the rigid nose shaft between the motor housing and the nose cone.

A further embodiment of the invention provides a method for cleaning a bore. The method comprises providing an apparatus of the invention, positioning the apparatus in an end of a bore, and actuating the vibratory motor to propel the apparatus through the bore.

DETAILED DESCRIPTION OF THE INVENTION

Figure 1:
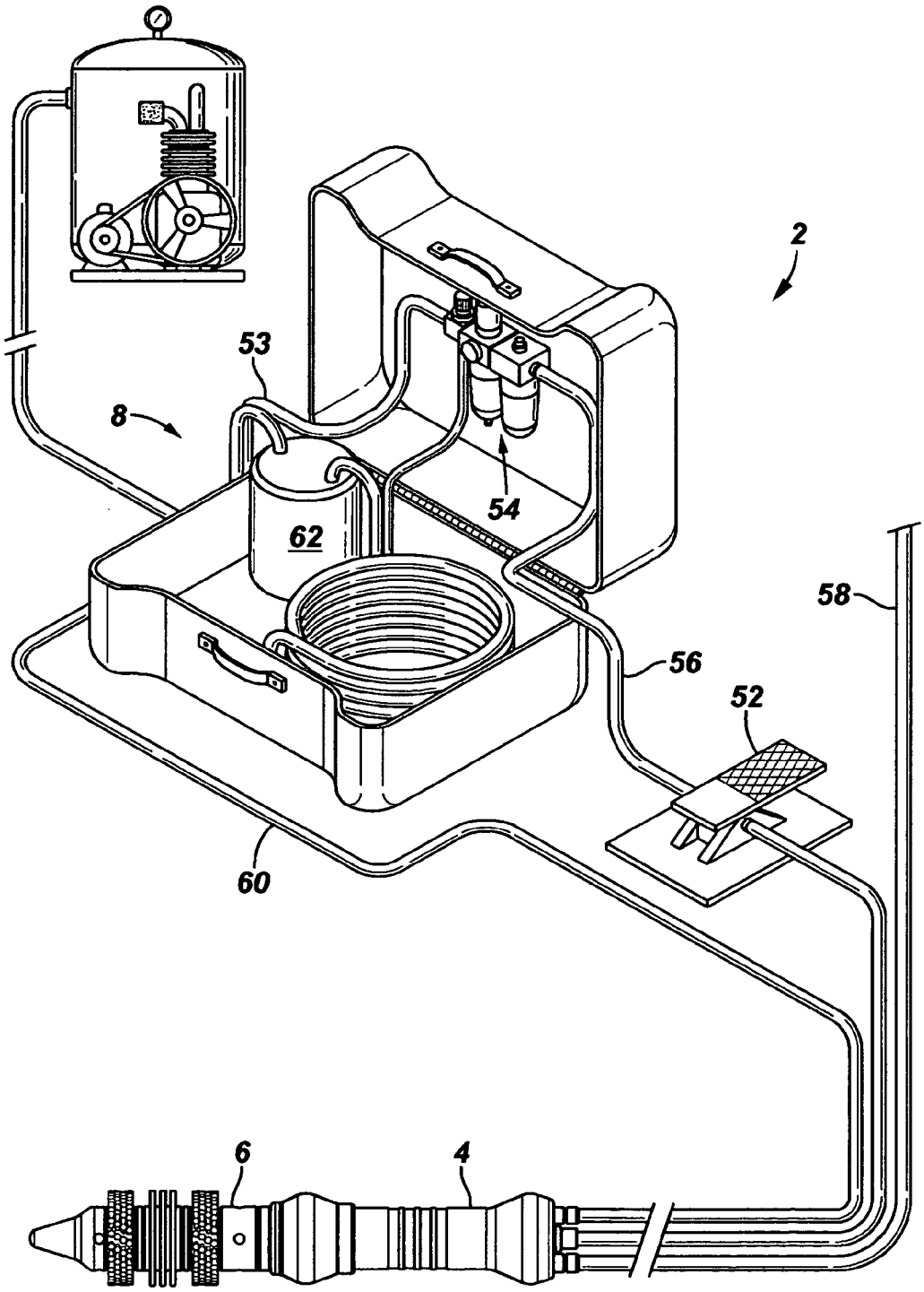
FIG. 1 pictorially illustrates a bore cleaning system according to an embodiment of the invention.

With reference to FIG. 1, in a preferred embodiment of the invention, a cleaning system 2 is deployed as in the form of a pneumatic motor unit 4, a brush assembly 6, of which there can be several for conducting the various cleaning stages, and a package 8 containing accessories, hoses and controls.

Figure 2:
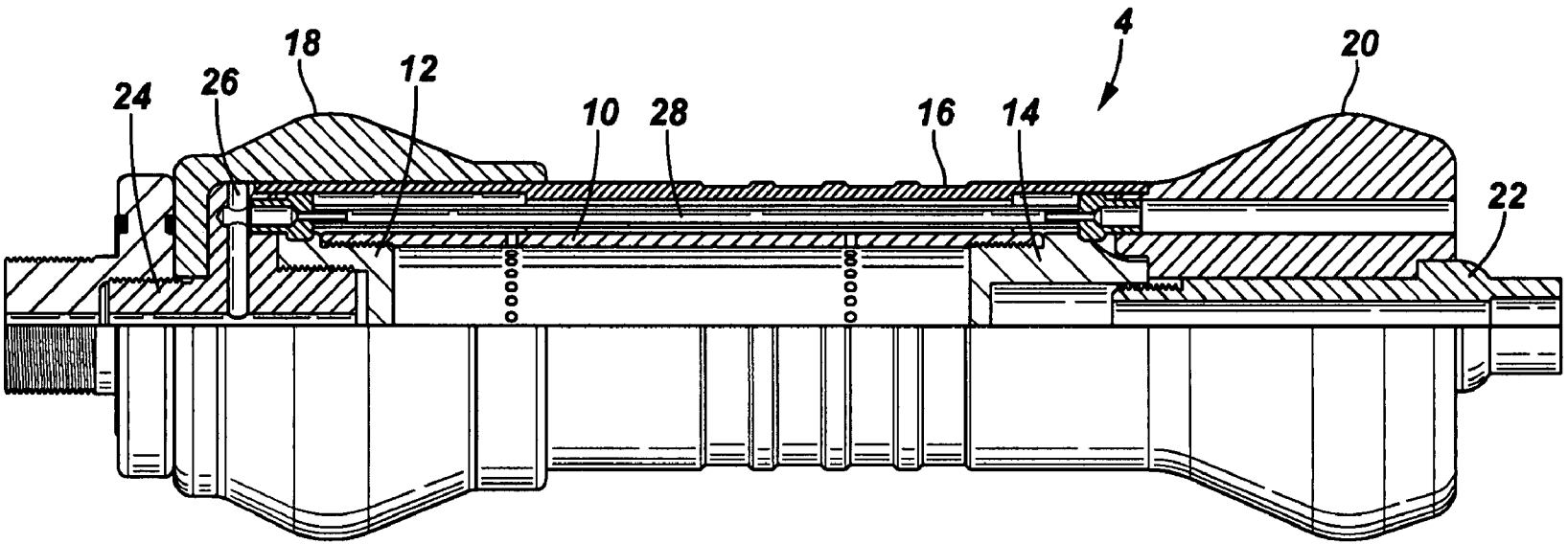
FIG. 2 is a plan view of a motor unit suitable for use in the system of FIG. 1 taken in partial cross section.

With reference to FIG. 2, the pneumatic motor unit is for driving each of the brush assemblies through the bore to be cleaned. It comprises a vibratory motor (further detailed in FIG. 6) having an internal reciprocating annular piston riding between an axially positioned spindle and an outer sleeve 10. A nose end cap 12 and a tail end cap 14 seal the outer sleeve to form the cylinder heads and are preferably provided with threads on their outside ends. A generally cylindrical outer sidewall 16 surrounds the outer sleeve is fixedly attached to the nose end cap and the tail end cap. The outer sidewall has a nose end and a tail end and an outside diameter.

A nose end centralizer body 18 is mounted to the nose end of the generally cylindrical sidewall. The nose end centralizer body forms a guide to facilitate the pneumatic motor unit being received in a bore to be cleaned. A tail end centralizer body 20 is mounted to the tail end of the generally cylindrical sidewall. The tail end centralizer body forms a guide to facilitate said pneumatic motor unit being received in a bore to be cleaned. The centralizer bodies are sized to be closely received by the bore to be cleaned. In this manner, the same motor can be deployed effectively in a wide range of bore sizes, simply by changing out the centralizer bodies.

The nose end centralizer body and the tail end centralizer body can generally be described as each having an outside diameter which is greater than the outside diameter of the generally cylindrical outer sidewall. Each of the centralizer bodies also has generally frustoconically shaped fore and aft facing surfaces to facilitate receipt of the motor unit in the bore to be cleaned.

In the illustrated embodiment, the tail end centralizer body is retained in position on the tail end of the generally cylindrical sidewall by a rigid shaft 22 extending axially from the tail end cap. The nose end centralizer body is received over an annularly flanged front support adapter body 24 mounted to the front end cap. The support adapter also defines an oil passage 26 to provide oil from an oil tubing 28 to the brush assembly.

Figure 3:
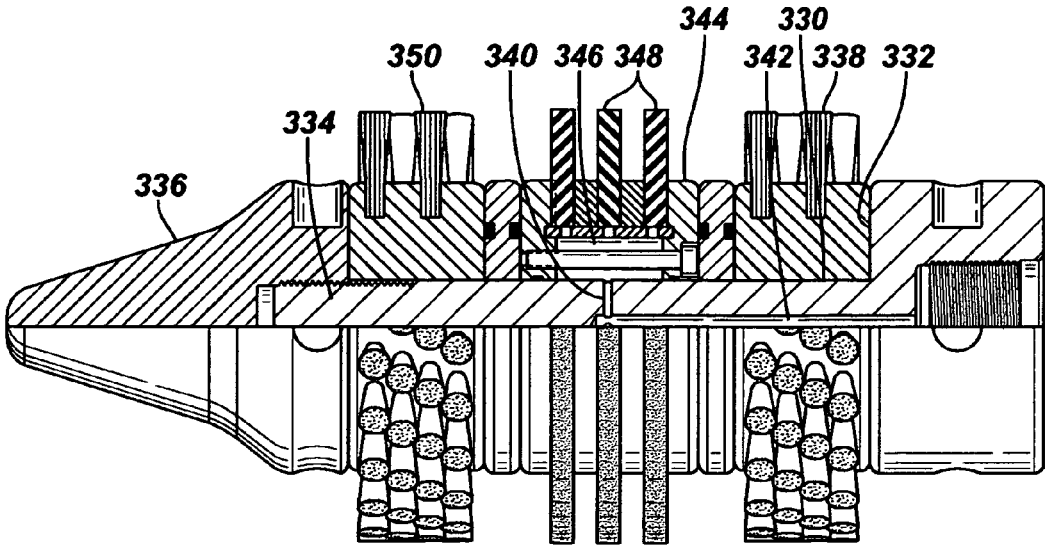
FIG. 3 is a plan view of a brush assembly suitable for in the system of FIG. 1 taken in partial cross section.
Figure 4:
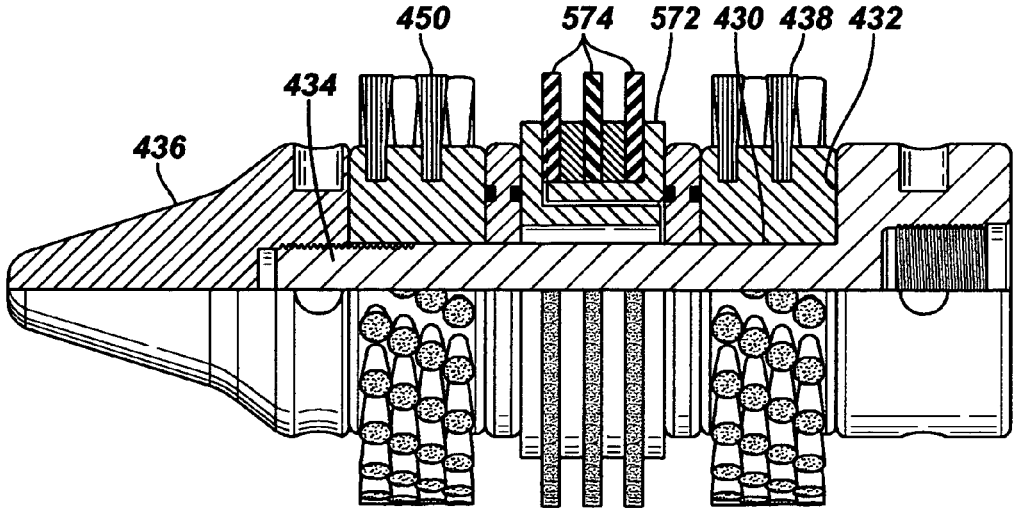
FIG. 4 is a plan view of another brush assembly suitable for in the system of FIG. 1 taken in partial cross section.
Figure 5:
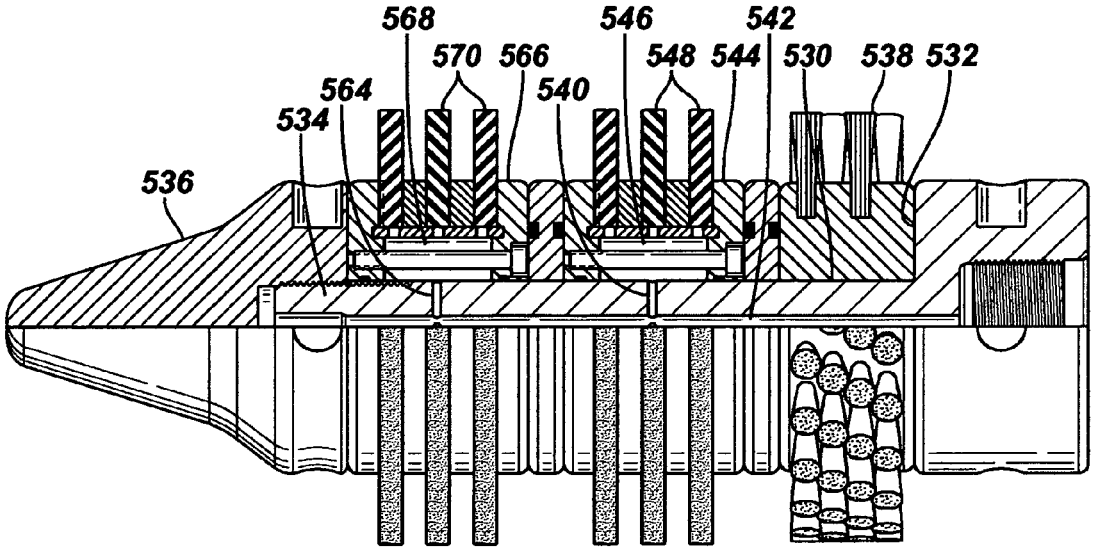
FIG. 5 is a plan view of another brush assembly suitable for in the system of FIG. 1 taken in partial cross section.

Three brush assemblies are disclosed for attachment to the motor unit to perform different cleaning operations in FIGS. 3, 4, and 5. Each assembly includes a mandrel 330, 430, 530 having an annular flange 332,432,532, a shaft 334,434,534 extending axially from the annular flange, and has a nose end and a tail end. A nose cone 336,436,536 is mounted on the nose end of the mandrel. A first collar shaped brush 338,438, 538 is fixedly mounted on the shaft.

In the embodiment illustrated in FIG. 3, the shaft defines at least one first generally radially extending passage 340 and an axially extending passage 342 leading from the tail end of the mandrel to the radially extending passage. A first collar assembly 344 is fixedly mounted to the shaft in covering relationship with the at least one radially extending passage and forms an annular distribution chamber 346 around the shaft. A plurality of fibrous washers 348 forming part of the collar assembly are positioned in flow communication with the annular distribution chamber. Preferably, a second collar shaped brush 350 is fixedly mounted to the shaft. The collar assembly is positioned between the first collar shaped brush and the second collar shaped brush. The nose cone is threadably attached to the shaft to press the first collar shaped brush, the collar assembly, and the second collar shaped brush between the nose cone and the annular flange.

The just described head is useful to clean bores, such as smoothbore and rifled cannon bores. In a workshop cleaning scenario, the procedure is preferably to clean the barrel with the cleaning brush, squeegee the barrel with the squeegee brush to permit calibrated inspection, and then oil the barrel with the oiling brush to leave an oil film deposit for preservation. For field use, if supported by a drops vehicle or similar with compressed air, the procedure is preferably to clean the barrel with the cleaning brush and squeegee the barrel with the squeegee brush to remove the oil.

The head is attached to the front of the base unit as shown in FIG. 1. A foot valve 52 acts as a valve and controls the air supply to the base unit. An air supply line 53 is attached to an inlet on a filter/regulator/lubricator 54. A line, such as a ⅜ inch line 56, is attached from the filter/lubricator to the foot valve to the base unit. This supplies air to the unit. An exhaust line 58 is attached to the base unit. This allows exhaust air to vent outside of the cannon tube. A ¾ inch line is suitable. A line 60, such as ⅛ inch PVC is attached from the liquid container 62 to the back of the base unit. This allows for use of CLP or other oil during the cleaning process. The oil flows through the flow passages in the head assembly and distributes oil via the washers, which are preferably constructed of nonwoven material, such as felt. In order to use the tool, it is inserted a few inches into the cannon bore and actuated using the foot valve. When it reaches the other end, the operator tugs on the air line to reverse direction of the tool so that it can return to the operator.

Once the cleaning operation is completed, the operators can replace the cleaning head with the squeegee head to wipe excess oil from the bore and permit inspection. See FIG. 4. The oil passage is unnecessary for this operation. In the squeegee head, a second collar shaped brush 450 is fixedly mounted on the shaft. A collar assembly 572 is fixedly mounted to the shaft between the first collar shaped brush and the second collar shaped brush. The collar assembly carries a plurality of rubbery washers 574 to perform the wiping operation. The nose cone is threadably attached to the shaft to press the first collar shaped brush, the collar assembly, and the second collar shaped brush between the nose cone and the annular flange to make a compact unit.

Once the squeegee operation is completed, the operators can replace the squeegee head with an oiling head. See FIG. 5. The shaft defines at least one first generally radially extending passage 540 and an axially extending passage 542 leading from the tail end of the mandrel to the radially extending passage. A first collar assembly 544 is fixedly mounted to the shaft in covering relationship with the at least one radially extending passage and forms an annular distribution chamber 546 around the shaft. A plurality of fibrous washers 548 forming part of the collar assembly are positioned in flow communication the annular distribution chamber. In the oiling head, the shaft further defines at least one second generally radially extending passage 564 longitudinally spaced apart from the first generally radially extending passage. The at least one second generally radially extending passage is also in flow communication with the axially extending passage. The apparatus further comprises a second collar assembly 566 fixedly mounted to the shaft in covering relationship with the at least one second radially extending passage and forming an annular distribution chamber 568 around the shaft. A plurality of fibrous washers 570 form part of the second collar assembly and are in flow communication with the annular distribution chamber. The nose cone is threadably attached to the shaft to press the first collar shaped brush, the first collar assembly, and the second collar assembly between the nose cone and the annular flange. The collar shaped brush is positioned against the annular flange.

The preferred motor housing preferably further comprises an outer sidewall defining an axially extending bore and surrounding an outer sleeve of the motor, an annulus being formed between the outer sidewall and the sleeve. An oil line is positioned alongside the sleeve in the annulus to carry oil from a tail end of the device to the oil passage. The oil line is used to supply cleaning and preservative oil preferably meeting military specifications, for example ROYCO 463, MIL-L-63460 D AM2, Cleaner, Lubricant, Preservative (CLP) during the cleaning and oiling stages of the cleaning procedure. Different oils can be used at different stages of the cleaning process. The outer sidewall permits exhaust gases from the ports in the sleeve to be captured and routed away from the operator. Where the barrel contains noxious and/or toxic substances, this is a preferred way for carrying out the invention. For example, where the barrel has been used to fire depleted uranium projectile. Also, the barrels are preferably cleaned from the muzzle end, and are inclined slightly downward to permit drainage of cleaning oil away from the breech.

In certain of the illustrated embodiments, the nose end cap further defines a generally radially extending oil passage leading from the oil line to the generally longitudinally extending oil passage 342, 542 in the rigid nose shaft, although oiling is generally not desirable in the final stage of cleaning. The brushing means employed for the cleaning stage preferably comprises at least two collar shaped brushes surrounding the rigid shaft, each at a fixed longitudinal position, and the outlet to the oil passage is positioned between a pair of the collar shaped brushes. The brush bodies and bristles are preferably formed from a material which will not damage the bore, such as, in the case of the body, aluminum or engineering plastic such as Delrin, which is an acetal resin, and in the case of the bristles, nylon and phosphor/bronze mix, or any other materials that are approved by the manufacturer of the barrel in question.

The illustrated invention generally includes a rigid tail pipe extending generally axially from a tail end of the vibratory motor. A tail guide is retained in position by the tail pipe. Preferably, the tail guide has an outside diameter which is slightly less than an outside diameter of the brush means, so as to act as a centralizer for a rear end of the cleaning apparatus. Because the apparatus is modular in construction, different diameter brush means, nose cones and tail pieces can be readily installed as needed for the cleaning of different diameter bores.

The tail guide preferably defines passages to permit fluid supply and fluid exhaust to and from the apparatus. The tail guide defines a first passage for connection to the tail pipe for the supply of gas to the motor spindle, a second passage for connection to the annulus, for the exhaust of gas from the annulus, and a third passage for connection to oil line, for the supply of oil to the oil passage. An oil supply is connected to the third passage, an air compressor connected to the first passage, and an exhaust gas line connected to the second passage.

In one embodiment of the invention, there is provided an apparatus for cleaning a tubular which comprises a vibratory motor contained in a motor housing, a nose shaft extending from one end of the motor housing, a nose cone positioned on an end of the shaft, and a brush positioned on the shaft between the nose cone and the vibratory motor. The vibratory motor is of the type having an internal reciprocating piston riding between an axially positioned spindle and an outer sleeve. A nose end cap and a tail end cap seal the ends of the outer sleeve. The rigid nose shaft extends axially from the nose end cap. The rigid nose shaft has a nose end and a tail end. A nose cone is positioned on the nose end of the rigid nose shaft to facilitate starting the cleaning apparatus into a tubular. The brushing means comprises at least one collar shaped brush longitudinally fixedly positioned around the rigid nose shaft between the end cap and the nose cone. The brushing means has near radially-extending bristles which are sized to resiliently contact an inside wall of the tubular so that reciprocation of the piston scoots the cleaning apparatus through the tubular in a series of short lunges. The outside diameter of the collar on the periphery of the bristles is preferably slightly greater than the inside diameter of the tubular, so that a majority of the bristles lean backwards when the device is slid into the bore.

Figure 6:
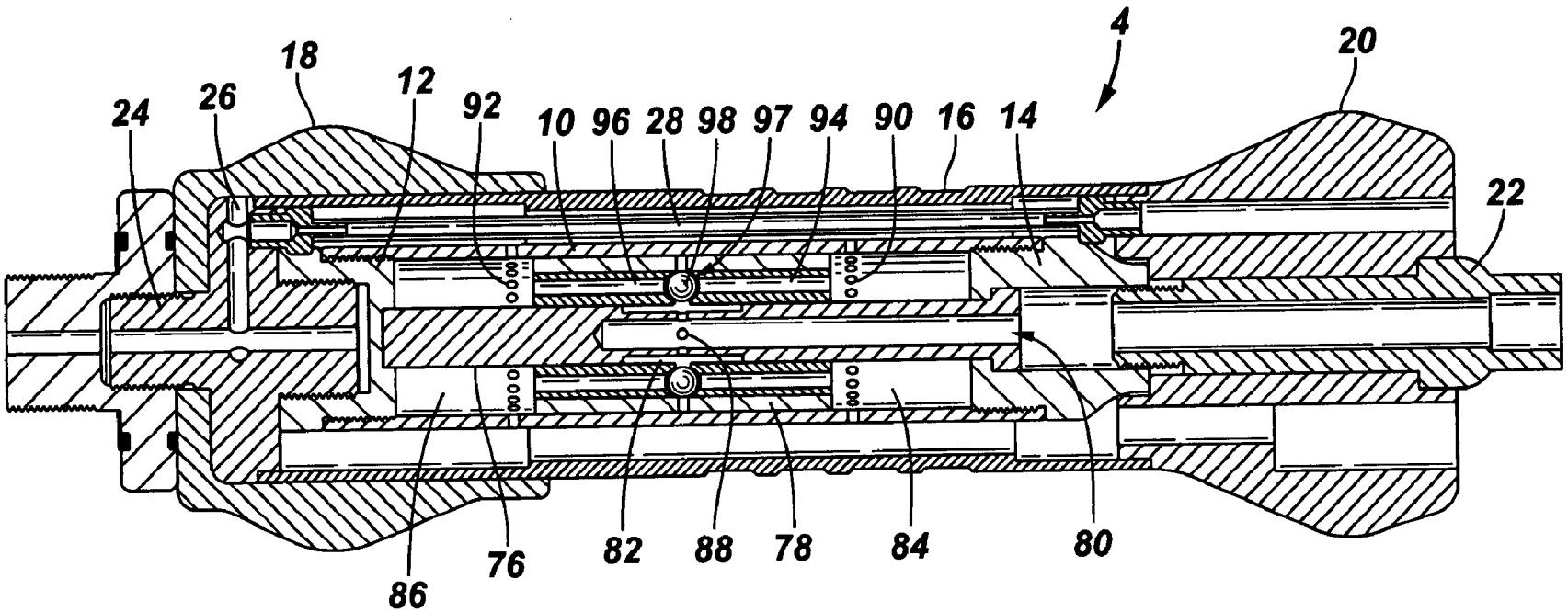
FIG. 6 is cross sectional view of a motor unit suitable for use in the system of FIG. 1 showing internal details.

A vibratory motor according to one embodiment of the invention is shown in FIG. 6. The motor comprises a cylinder 10, a spindle 76, and a tubular piston 78. The cylinder has a longitudinal axis. The spindle has an axially extending passage 80 mounted along the longitudinal axis of the cylinder. The tubular piston is slidably mounted between the spindle and the cylinder.

An annular distribution chamber 82 is defined between the spindle and the piston. In the illustrated embodiment, the chamber is formed by a recess in the outer surface of the spindle, although it could also be provided by mounting the piston on bushings, or machining a hollowed area in the piston. A first chamber 84 is formed between a first end of the piston and a first end of the cylinder. A second chamber 86 is formed between a second end of the piston and a second end of the cylinder.

The hollow spindle defines at least one inlet port 88 which defines a flow path between the axial passage and the distribution chamber when the piston is in a first longitudinal position (as illustrated). The cylinder defines at least one first exhaust port 90 which defines a flow path leading from the first chamber when the piston is in a second longitudinal position (moved left) and at least one second exhaust port 92 leading from the second chamber when the piston is in a third longitudinal position (moved right). In operation, the first exhaust port is blocked by a portion of the piston during part of the period that the second exhaust port forms the flow path and the second exhaust port is blocked by the piston during part of the period when first exhaust port forms the flow path. The inlet port is blocked by a first portion of the piston when the first exhaust port is blocked and by a second portion of the piston when the second exhaust port is blocked.

The piston defines at least one first flow path 94 leading from the annular distribution chamber to the first chamber and at least one second flow path 96 leading from the annular distribution chamber to the second chamber. A valve means 97 is carried by the piston to alternately open and close the first flow path and the second flow path to the annular distribution chamber responsive to pressure difference between the first chamber and the second chamber.

In the illustrated embodiment, the first flow path and the second flow path extend away from each other and the valve means comprises a ball 98 loosely positioned in a ball chamber between the first flow path and the second flow path and sized to seal the first flow path and the second flow path. The ball chamber is in flow communication with the annular distribution chamber when the piston is in the first longitudinal position. The motor is operated by placing a source of pressurized gas in flow communication with the passage in the spindle, as illustrated in FIG. 1. Piston travel is limited by compressed gas in the cylinder head at the end of each stroke, so that metal to metal contact is avoided. As pressure increases in the diminishing head chamber, it decreases in the expanding head chamber, which is no longer being supplied with gas and has open exhaust ports. The increasing pressure difference unseats the ball, and reseats it over the inlet to the low pressure chamber. Once the piston rebounds sufficiently to reopen the gas supply in the spindle, pressurization drives the piston to the other end of the cylinder, where the cycle repeats.

Preferably, the rigid nose shaft further defines a longitudinally extending oil passage having an outlet adjacent the at least one collar-shaped brush. If desired at least one generally radially directed nozzle can be positioned at the oil outlet. However, for practical purposes, the nozzles are not necessary.

While certain preferred embodiments of the invention have been described herein, the invention is not to be construed as being so limited, except to the extent that such limitations are found in the claims.

What is claimed is:

1. A cleaning apparatus for tubulars comprising a longitudinally elongated vibratory motor contained in a motor housing, a rigid nose shaft extending axially from one end of the motor housing, said rigid nose shaft having a nose end and a tail end;

a nose cone positioned on the nose end of the rigid nose shaft to facilitate starting the cleaning apparatus into a tubular; and a brushing means which comprises at least one collar shaped brush longitudinally fixedly positioned around the rigid nose shaft between the motor housing and the nose cone, wherein the vibratory motor is of the type having an internal reciprocating piston, riding between an axially positioned spindle and an outer sleeve, a nose end cap and a tail end cap sealing the outer sleeve, wherein the piston is closely mounted in the sleeve for reciprocating motion back and forth, said piston having a longitudinal axis, a first end and a second end and at least one longitudinally extending gas passage offset from the longitudinal axis to convey gas alternatively to the first end or the second end to drive the piston back and forth, and the spindle has at least one radial outlet to supply driving gas to the piston, wherein the brushing means has near radially-extending bristles which are sized to resiliently contact an inside wall of the tubular so that reciprocation of the piston scoots the cleaning apparatus through the tubular in a series of short lunges, and wherein wherein the rigid nose shaft further defines a longitudinally extending oil passage having an outlet adjacent the at one collar-shaped brush, wherein the motor housing further comprises an outer sidewall surrounding the outer sleeve of the motor, said outer sidewall defining an axially extending bore and having a nose end and a tail end, an annularly shaped passage being formed between the outer sidewall of the outer sleeve, and said apparatus further comprising an oil line positioned in the annulus to carry oil from a tail end of the apparatus to the oil passage.

2. Apparatus as in claim 1 further comprising a rigid tail pipe extending generally axially from a tail end of the vibratory motor, and a tail guide retained in position by the tail pipe, said tail guide having an outside diameter which is slightly less than an outside diameter of the brush means, so as to act as a centralizer for a rear end of the cleaning apparatus.

3. Apparatus as in claim 2 wherein the tail guide defines a first passage for connection to the tail pipe for the supply of gas to the spindle, a second passage for connection to the annulus for the exhaust of gas from the annulus, and a third passage for connection to an oil line, for the supply of oil to the oil passage.

4. Apparatus as in 3 further comprising an oil supply connected to the third passage, an air compressor connected to the first passage, and an exhaust gas line connected to the second passage.

5. A method for cleaning a bore, said method comprising providing an apparatus as in claim 1, positioning the apparatus in an end of a bore, and actuating the vibratory motor to propel the apparatus through the bore.

6. A method as in claim 5 further comprising providing a supply of oil to the oil passage, and applying oil to the inside of the bore adjacent to the collar shaped brush.

* * * * *